US005257578A

United States Patent [19]

Jackson et al.

[11] Patent Number: 5,257,578

[45] Date of Patent: Nov. 2, 1993

[54] DEVICE FOR AUTOMATICALLY CLEANING BLANKET CYLINDERS IN A OFFSET PRINTING PRESS

[75] Inventors: Barry M. Jackson, York, Me.; Dave C. Gibson, Barrington, N.H.

[73] Assignee: Heidelberger Druckmaschinen AG, Heidelberg, Fed. Rep. of Germany

[21] Appl. No.: 3,355

[22] Filed: Jan. 12, 1993

[51] Int. Cl.[5] ..... B41F 35/00

[52] U.S. Cl. ..... 101/425; 15/256.52; 118/104; 118/70

[58] Field of Search ..... 101/425, 423, 424; 15/256.51, 256.52, 256.53; 118/203, 104, 70

[56] References Cited

U.S. PATENT DOCUMENTS

| | | | |
|---|---|---|---|
| 3,735,702 | 5/1973 | Kossak | 101/425 |
| 3,763,778 | 10/1973 | Sills et al. | 15/256.52 |
| 4,015,307 | 4/1977 | Kossak | 15/256.52 |
| 4,072,106 | 2/1978 | Junghans et al. | 101/425 |
| 4,232,604 | 11/1980 | Waizmann | 101/425 |
| 4,311,095 | 1/1982 | Jeschke | 101/425 |
| 4,344,361 | 8/1982 | MacPhee et al. | 101/425 |
| 4,397,235 | 8/1983 | Fischer | 101/425 |
| 4,686,902 | 8/1987 | Allain et al. | 101/424 |
| 4,722,273 | 2/1988 | Jahn | 101/142 |
| 4,747,348 | 5/1988 | Jeschke et al. | 101/425 |
| 4,757,763 | 7/1988 | MacPhee et al. | 101/425 |
| 4,841,862 | 6/1989 | Seefried | 101/425 |
| 4,875,412 | 10/1989 | Wright et al. | 101/425 |
| 5,035,178 | 7/1991 | Jahn et al. | 101/425 |

FOREIGN PATENT DOCUMENTS

| | | |
|---|---|---|
| 3120983 | 4/1982 | Fed. Rep. of Germany . |
| 3806609A1 | 10/1988 | Fed. Rep. of Germany . |
| 3901105 | 1/1990 | Fed. Rep. of Germany . |
| 3900657 | 6/1990 | Fed. Rep. of Germany . |
| 3900656 | 7/1990 | Fed. Rep. of Germany . |
| 3909819 | 9/1990 | Fed. Rep. of Germany . |
| 59-161197 | 9/1984 | Japan . |

*Primary Examiner*—Eugene H. Eickholt
*Attorney, Agent, or Firm*—Kenyon & Kenyon

[57] ABSTRACT

The present invention provides an automatic cleaning device for cleaning blanket cylinders in a web fed offset lithographic printing press. The device includes at least one brush roller for removing foreign matter from a blanket cylinder. The device also includes pneumatic cylinders which bring the brush roller into engagable contact with the blanket cylinder and the web. A flicker roller is also provided for flicking particles and other waste debris off the brush roller. In an engaged position, the brush roller, blanket cylinder and the web form an enclosed triangular region with the flicker roller being disposed within this region. This enables the device to be self-cleaning while at the same time prevents blanket wash waste from invading inker and dampening units.

19 Claims, 2 Drawing Sheets

DEVICE FOR AUTOMATICALLY CLEANING BLANKET CYLINDERS IN A OFFSET PRINTING PRESS

FIELD OF THE INVENTION

The present invention relates generally to a cleaning device for printing units, and more particularly to a device for automatically cleaning blanket cylinders in an offset lithographic printing press.

BACKGROUND OF THE INVENTION

Offset printing presses employ blanket cylinders for transferring images from printing plates to a web material. Typically, blanket cylinders have printing blankets with rubber surfaces mounted thereon which transfer the images.

Continuous printing is made possible by wrapping a printing plate or a plurality of printing plates around the surface of a plate cylinder designed for rotation in contact with the blanket cylinder. In operating blanket-to-blanket presses, a web of material passes between two blanket cylinders mounted such that one blanket cylinder serves as an impression cylinder for the other, resulting in simultaneous printing on both sides of the web of material.

However, during continuous offset printing, the printing blankets mounted on the blanket cylinders accumulate foreign matter such as dried ink or ink build-up, lint, dust, clay, dirt and the like which must be removed to maintain the quality of the printed product. Therefore, during a specific run or job, the printing blankets must be cleaned at various times during the running of the job. Additionally, the printing blankets must also be cleaned to remove the image when the job is complete. Still further, the blankets must be cleaned during "make ready" operations. Each time the printing blankets must be cleaned, there is machine down-time.

In the past, printing blankets were cleaned by hand. However, this method had numerous problems and was extremely time consuming. Recently, several automatic and semi-automatic blanket cleaning devices have been developed and employed for accomplishing this cleaning. However, these devices have a number of drawbacks.

For one, these devices are not capable of removing blanket wash waste without dirtying the devices themselves in the process, i.e., they are not self-cleaning. Second, these devices create a mist of blanket wash waste which invades and contaminates surrounding inker and dampening units disrupting the quality of the printed product.

OBJECTS AND SUMMARY OF THE INVENTION

An object of the present invention is to provide an automatic blanket cleaning device which is self-cleaning.

Another object of the present invention is to provide an automatic blanket cleaning device which prevents blanket wash mist from invading surrounding inker and dampener units.

The present invention provides a device for cleaning a blanket cylinder in a web fed offset printing press, comprising: at least one brush roller for removing foreign matter from the blanket cylinder; means for bringing the brush roller into engagable contact with the blanket cylinder and the web; and means for cleaning the brush roller of the foreign matter removed from the blanket cylinder. Once the device is engaged, the brush roller, blanket cylinder and the web form an enclosed triangular region with the brush roller cleaning means being disposed within this region.

The present invention may also be utilized to clean impression cylinders as well as blanket cylinders and printing blankets.

The present invention also provides a means for spraying the brush roller with a blanket wash solution.

One advantage of the present invention is that by forming an enclosed triangular region, the brush roller, blanket cylinder and the web create a barrier which prevents the blanket wash solution and foreign matter from invading nearby inker and dampening units. This helps maintain the print quality of the printed product during running of the printing press.

Another advantage of the present invention is that all components of the cleaning device are in motion within the triangular region, thereby providing a continuous surface which is self-cleaning. Therefore, operator time is saved by not having to clean the cleaning device, as is the case with known blanket cleaning devices.

These and other objects, advantages and characteristics of the present invention will become apparent in view of the following description and accompanying drawings.

DETAILED DESCRIPTION

Figure 1:
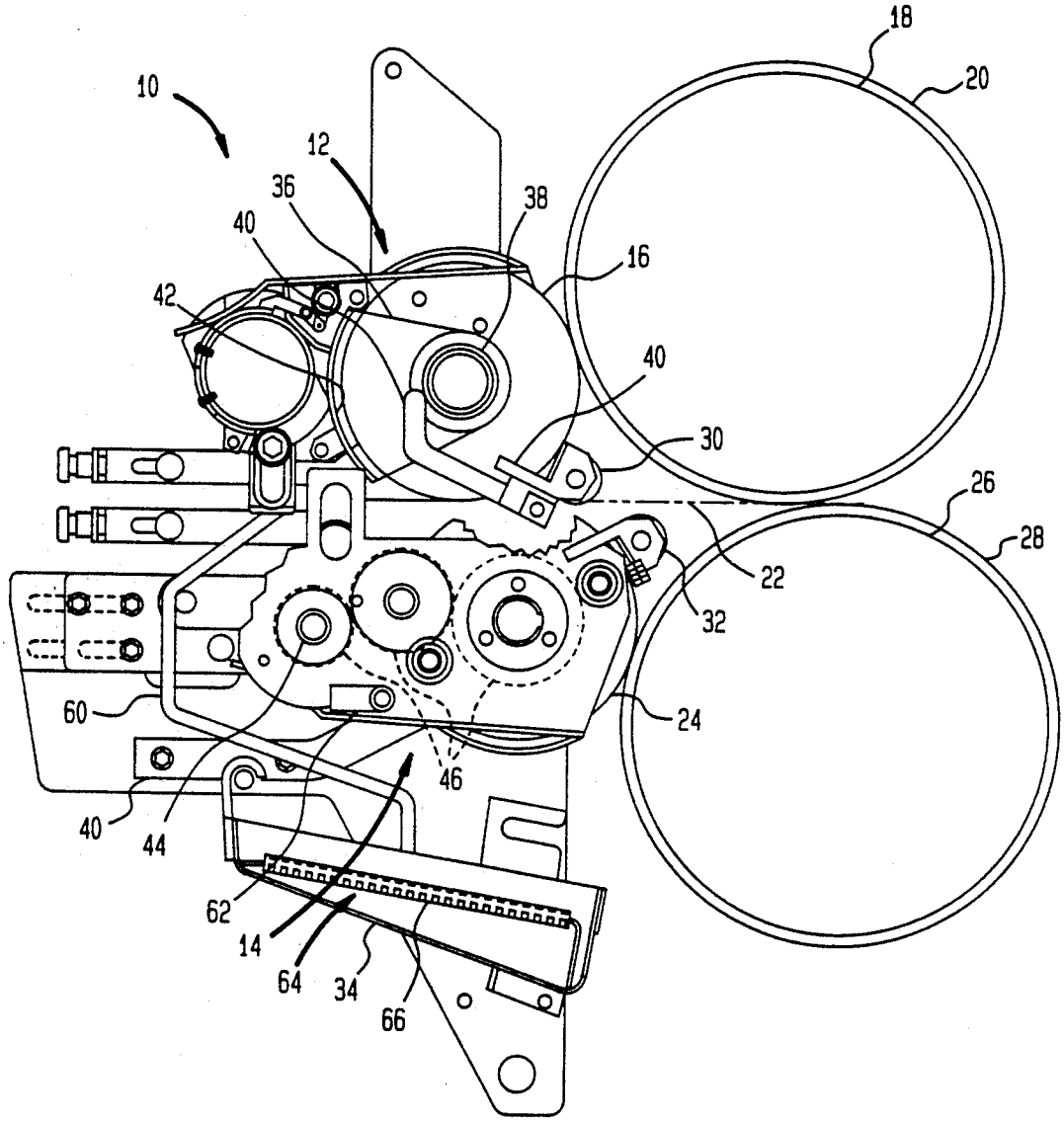
FIG. 1 is a side elevation view of a cleaning device of the present invention, shown in operative position, in relation to upper and lower blanket cylinders.

In FIG. 1, a device for automatically cleaning blanket cylinders is indicated generally by the reference numeral 10. The cleaning device 100 has an upper washer unit 12 and a lower washer unit 14. The upper washer unit 12 has a rotating brush roller 16 which simultaneously contacts an upper blanket cylinder 18, having a printing blanket 20 axially mounted thereon, and a web 22. The lower washer unit 14 has a corresponding rotating brush roller 24 which simultaneously contacts a lower blanket cylinder 26, having a printing blanket 28 axially mounted thereon, and the web 22.

The cleaning device 10 of the present invention is preferably integral with a printing unit of a printing press. Prior to activation of the cleaning device 10, the upper and lower washer units 12 and 14 are in a disengaged position. In this position, the off mode (not shown), the upper washer unit 12 is located adjacent to the upper blanket cylinder 18 and above the web 22, but is not in contact with either the upper blanket cylinder or the web, and the lower washer unit 14 is located adjacent to the lower blanket cylinder 26 and below the web 22, but is not in contact with either the lower blanket cylinder or the web.

When the cleaning device is in the off mode, the printing press can operate at normal speed with the web 22 traveling between the upper and lower washer units 12 and 14, enabling normal printing operations to take place. When it is desired to clean the upper and lower printing blankets 20 and 28, the cleaning device 10 can be moved into the engaged position. At any speed up to 3000 feet per minute.

Pneumatic cylinders are used to move the cleaning device 10 of the present invention into the engaged position. These cylinders move the cleaning device 10 along a track in a straight line toward the blanket cylinders 18 and 26 at an angle of 24½° to the web 22, until the brush roller 16 contacts both the blanket cylinder 18 and the web 22, and the brush roller 24 contacts both the blanket cylinder 26 and the web 22. For both the engaged and disengaged position, the cleaning device 10 acts a protective guard preventing an operator from getting his or her hand or arm caught in the nip between the upper and lower blanket cylinders 18 and 26.

During operation of the cleaning device 10, the brush roller 16 rotates in the same direction as, but at a slower differential speed than, the blanket cylinder 18, so that respective mutually opposing adjacent locations of the brush roller 16 and blanket cylinder 18 are travelling in opposite directions. This allows the brush roller 16 to brush across the surface of the printing blanket 20 cleaning it free of particles and other debris.

Just prior to contacting the printing blanket 20 and web 22, a blanket wash solution containing a solvent, e.g., water, is applied to the brush roller 16. Particles are loosened from the pores of the printing blanket 20 by the brush roller 16. These particles are removed by the web 22 passing through a nip between the upper blanket cylinder 18 and the lower blanket cylinder 26. Any blanket wash solution and particles remaining on the brush roller 16, after contacting the printing blanket 20, are removed from the brush roller onto the web 22 by a flicker roller 30.

In the engaged position, the brush roller 16, blanket cylinder 18 and the web 22 form an upper enclosed triangular region. The web 22 coming in contact with the brush roller 16, further cleans the brush roller and acts as a barrier, preventing any airborne blanket wash solution and/or foreign matter (mist) from coming into contact with inker and dampening units. All components which form the triangle are in motion, thereby providing a continuous surface which is self-cleaning. The blanket wash solution is contained in the triangle until it is driven between the nip between the upper and lower blanket cylinders 18 and 26.

To clean the brush roller 16 further, the brush roller contacts the flicker roller 30 which has a surface speed which is less than that of the brush roller. While in contact with the brush roller 16, the flicker roller 30 flicks particles off the brush roller directly onto the web 22. The flicker roller 30 is disposed within the triangular region, thereby preventing debris from accumulating on it and making it self-cleaning as well. Although the flicker roller 30 may have a smooth surface, it is preferable if it has grooves axially extending along its length.

The lower washer unit 14 operates in a similar manner to the upper washer unit 12. The brush roller 24, simultaneously contacting the lower blanket cylinder 26 and the web 22, rotates in the same direction as, but at a slower differential speed than, the lower blanket cylinder, so that respective mutually opposing adjacent locations of the brush roller and lower blanket cylinder are travelling in opposite directions. This enables the brush roller 24 to brush across the surface of the printing blanket 28 cleaning it free of particles and other debris.

In the engaged position, the brush roller 24, blanket cylinder 26 and the web 22 form a lower enclosed triangular region. The web 22 coming in contact with the brush roller 24, further cleans the brush roller and acts as a barrier, preventing any airborne blanket wash solution and/or foreign matter (mist) from coming in contact with inker and dampening units. All components which form the triangle are in motion, thereby providing a continuous surface which is self-cleaning. The blanket wash solution is contained in the triangular region until it is driven between the nip between the upper and lower blanket cylinders 18 and 26.

To clean the brush roller 24 further, a flicker roller 32, having a surface speed which is less than that of the brush roller, rotates in contact with the brush roller. While in contact with the brush roller 24, the flicker roller 32 flicks particles off the brush roller directly onto the web 22. The flicker roller 32 is disposed within the lower triangular region, thereby preventing debris from accumulating on it and making it self-cleaning as well. Although the flicker roller 32 may have a smooth surface, it is preferable if it has grooves axially extending along its length.

In the event that blanket wash waste (a mixture of blanket wash solution and foreign matter) may trickle down from the lower washer unit 14, a drip pan 34, disposed beneath the lower washer unit, is provided to collect the waste.

The upper washer unit 12 has a spray shield 36 which pivots around the brush roller 16 away from the web 22 when the cleaning device is activated. The spray shield 36 pivots around a brush journals bushing 38 and is advanced and retracted by a link 40 as the upper washer unit 12 slides into the engaged position. This prevents the shield 36 from contacting the web 22 and allows the brush roller 16 to form the third leg of the triangle. The shield 36 also functions as a drip pan in the off (retracted) position. Excess blanket wash solution which may trickle down from the brush roller 16 is captured by the shield 36, preventing droplets from falling directly onto the web 22. Drain holes 42 are provided at each end of the shield 36 to allow the excess solvent to drain into the drip pan 34.

The brush rollers are driven by an air motor 44 through a gear train 46. To maintain a constant RPM (revolutions per minute) and prevent the brush rollers from overspinning by the traction forces of the blanket cylinders, the air flow is restricted on the exhaust side of the air motor 44. A restricted exhaust line keeps the motor at a constant RPM above 30% press speed for a given air pressure. The motor 44 is housed in a cross-tie to shield it from solvents and debris.

Figure 2:
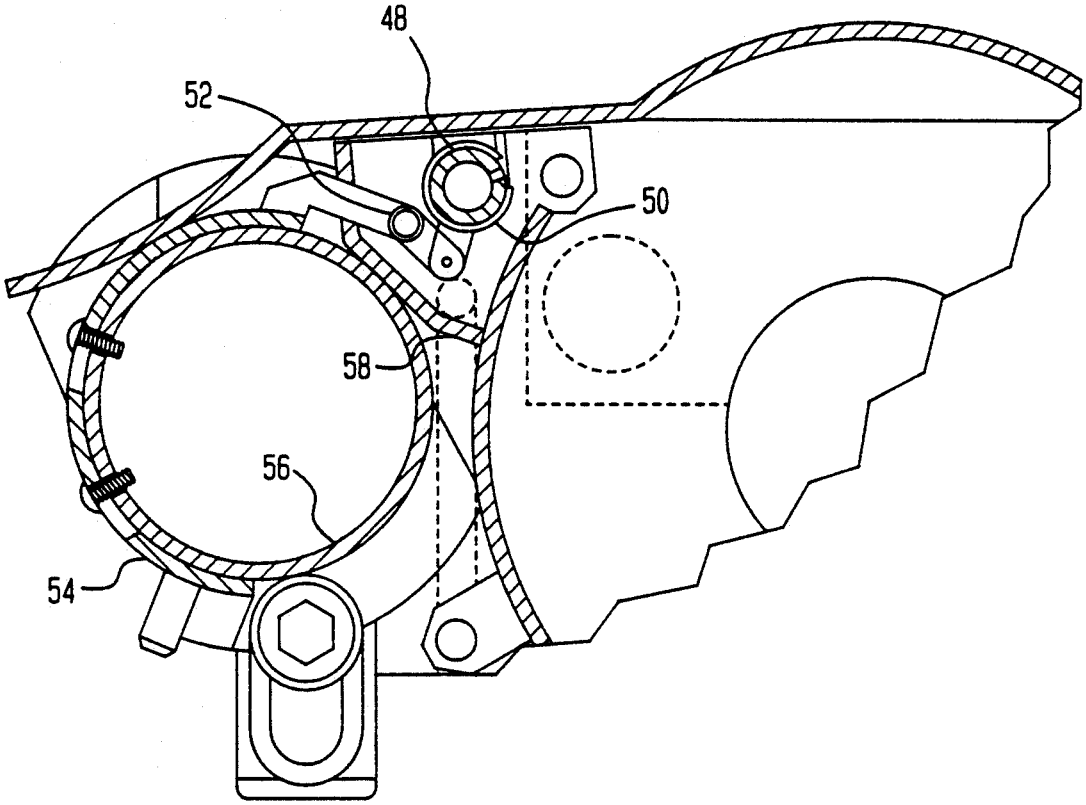
FIG. 2 is a side elevation view of a blanket wash solution applying means of the present invention, in relation to a fragmentary portion of a brush roller of the present invention.

The blanket wash solution is applied to the brush roller 16 by a spray bar 48, having a plurality of port holes through which the blanket wash is discharged, as shown in FIG. 2. These holes are sized diametrically to provide a uniform flow through each port. For a production run involving a narrow web, curtains are provided to divert the blanket wash to selected ports, so that the blanket wash is applied across only that portion of the brush roller 16 which contacts the web. These curtains comprise sleeves 50 which fit over the spray bar 48 and pivot in place to seal the ports. The sleeves 50 are preferably 4.5 inches in length (½ page width) and are disposed along the length of the spray bar 48. Links 52 are provided to pivot the curtains in place. The links 52 connect the sleeves 50 to horse collars 54. The horse collars 54 are mounted around a cross tie 56 and are also pivoted in place to open or close respective curtains. The location of the horse collars 54 allows the opening and/or closing to be determined during a web up since all adjustments which require closing would fall outside the web.

Any overflow from the spray bar 48 is caught by a trough 58 disposed beneath the spray bar, as shown in FIG. 2. This blanket wash solution is directed to the drip pan 34 via an overflow tube 60 to a recovery system, as shown in FIG. 1.

The lower washer unit 14 has a similar blanket washer applying means, including a spray bar 62, as shown in FIG. 1. However, rather than utilizing a pivotable spray shield for collecting any excess blanket wash solution which may trickle down from the brush roller 24, the drip pan 34 is used to capture this excess solution.

The drip pan 34 has a wire mesh 64 which stands off from the bottom of the drip pan and is provided with disposable filter paper 66, which completely covers the mesh to provide a prefiltration of ink solids from the blanket wash/ink waste, as shown in FIG. 1. This prevents drain lines from plugging up. The blanket wash is then pumped to a waste tank for further distillation.

While the present invention is capable of various modifications and alternative constructions, it not intended to limit the invention to the specific embodiments disclosed herein. Rather, it is intended to cover all modifications and alternative constructions falling within the spirit and scope of the invention as expressed in the claims. Furthermore, it is contemplated that the present invention may be used in various different arrangements. For example, it may be used to clean impression cylinders as well as blanket cylinders and printing blankets. That is, the present invention is not intended to be limited to cleaning blanket-to-blanket printing units.

We claim:

1. A device for cleaning a blanket cylinder in a web fed offset printing press, comprising:

at least one brush roller for removing foreign matter from the blanket cylinder;

means for bringing the brush roller into engagable contact with the blanket cylinder and the web; and means for cleaning the brush roller of the foreign matter removed from the blanket cylinder.

2. The device according to claim 1, wherein once engaged, the brush roller, blanket cylinder and web form an enclosed triangular region, the brush roller cleaning means being disposed within this region.

3. The device according to claim 2, further comprising a means for driving the brush roller independently of the blanket cylinder so that the brush roller is rotatable in the same direction of rotation as but at a slower differential speed than that of the blanket cylinder.

4. The device according to claim 3, further comprising means for spraying the brush roller with a blanket wash solution.

5. The device according to claim 4, wherein the blanket cylinder has a printing blanket axially mounted thereon.

6. The device according to claim 3, wherein the driving means is an air motor.

7. The device according to claim 1, wherein the brush roller cleaning means is a flicker roller which rotates at a surface speed less than that of the brush roller.

8. The device according to claim 7, wherein the flicker roller has grooves axially extending along its length.

9. The device according to claim 4, wherein the spraying means is a spray bar having a plurality of port holes through which the blanket wash solution is discharged.

10. The device according to claim 9, further comprising a plurality of sleeves fitted over the spray bar associated with the plurality of port holes which pivot in place and can seal selected ports, so that during a production run involving a narrow web, the blanket wash solution can be applied across only that portion of the brush roller which is in contact with the web.

11. The device according to claim 1, wherein the means for bringing the brush roller into engageable contact with the blanket cylinder and the web includes pneumatic cylinders.

12. The device according to claim 1, further comprising a spray shield pivotally mounted around the brush roller which pivots away from the web when the device is activated.

13. The device according to claim 4, further comprising a drip pan disposed beneath the brush roller.

14. The device according to claim 13, wherein the drip pan has a wire mesh standing off from its bottom adapted to accommodate a disposable filter paper which filters ink solids from blanket wash waste.

15. A device for cleaning an upper blanket cylinder and a lower blanket cylinder in a web fed offset printing press, comprising:

an upper brush roller for removing foreign matter from the upper blanket cylinder;

a lower brush roller for removing foreign matter from the lower blanket cylinder;

means for bringing the upper brush roller into engagable contact with the upper blanket cylinder and the web, and for bringing the lower brush roller into engagable contact with the lower blanket cylinder and the web;

first means for cleaning the upper brush roller of the foreign matter removed from the upper blanket cylinder; and second means for cleaning the lower brush roller of the foreign matter removed from the lower blanket cylinder.

16. The device according to claim 15, wherein once engaged, the upper brush roller, upper blanket cylinder and the web form an upper enclosed triangular region, the first brush roller cleaning means being disposed within this upper triangular region, and the lower brush roller, lower blanket cylinder and the web form a lower enclosed triangular region, the second brush roller cleaning means being disposed within this lower triangular region.

17. The device according to claim 16, further comprising means for spraying the upper and lower brush rollers with a blanket wash solution.

18. A device for cleaning a blanket cylinder and an impression cylinder in a web fed offset printing press, comprising:

first brush roller for removing foreign matter from the blanket cylinder;

second brush roller for removing foreign matter from the impression cylinder;

means for bringing the first brush roller into engagable contact with the blanket cylinder and the web, and for bringing the second brush roller into engagable contact with the impression cylinder and the web;

means for cleaning the first brush roller of the foreign matter removed from the blanket cylinder; and means for cleaning the second brush roller of the foreign matter removed from the impression cylinder.

19. The device according to claim 18, wherein once engaged, the first brush roller, the blanket cylinder and the web form an upper enclosed triangular region, the first brush roller cleaning means being disposed within this upper triangular region, and the second brush roller, impression cylinder and the web form a lower enclosed triangular region, the second brush roller cleaning means being disposed within this lower triangular region.

* * * * *